United States Patent [19]

Higgins et al.

[11] Patent Number: 5,049,726

[45] Date of Patent: Sep. 17, 1991

[54] RADIANT ELECTRIC HEATERS

[75] Inventors: George A. Higgins, Hagley; Kevin R. McWilliams, Stratford-upon-Avon, both of England

[73] Assignee: Germamaspeed Limited, Droitwich, England

[21] Appl. No.: 616,284

[22] Filed: Nov. 20, 1990

[30] Foreign Application Priority Data

Nov. 21, 1989 [GB] United Kingdom ..... 8926289

[51] Int. Cl.[5] ..... H05B 3/74

[52] U.S. Cl. ..... 219/464; 219/448

[58] Field of Search ..... 219/464, 466, 448, 449, 219/451, 452, 492, 494, 504, 505, 501

[56] References Cited

U.S. PATENT DOCUMENTS 2,681,973 6/1954 Macoicz ..... 219/481

4,639,579 1/1987 Brooks ..... 219/464

4,700,051 10/1987 Goessler ..... 219/464

4,789,772 12/1988 McWilliams ..... 219/464

FOREIGN PATENT DOCUMENTS 0235895 9/1987 European Pat. Off. .

*Primary Examiner*—Teresa J. Walberg

*Attorney, Agent, or Firm*—Browdy and Neimark

[57] ABSTRACT

A radiant electric heater has one or more infra-red image (22, 24) having a relatively high temperature coefficient of resistance. To reduce the inrush current when the lamps are first energized, a series resistance coil (54) is provided together with circuitry (64, 68, 70) to bypass the series resistance after a short time interval. Because the energy dissipated in the coil is relatively limited. It can be concealed beneath a peripheral insulating well (18) of the heater.

10 Claims, 3 Drawing Sheets

RADIANT ELECTRIC HEATERS

FIELD OF THE INVENTION

This invention relates to radiant electric heaters, and in particular to heaters of the kind incorporating an infra-red source such as an infra-red lamp or a molybdenum disilicide filament. Background of the invention Radiant electric heaters incorporating infra-red lamps have been described, for example in patent specifications EP 0 117 346 and GB 2 146 431. Such heaters are typically incorporated in cookers and cooktops having a flat, glass ceramic cooking surface. The type of lamp used comprises a tungsten filament supported inside a tubular envelope of fused silica, with electrical connections brought out through hermetic pinch seals at the ends of the envelope. The lamps are supported in a metal dish, above a layer of thermal insulation material compacted in the dish. It has also been proposed to use bare molybdenum disilicide filaments in place of lamps.

Owing to the high temperature coefficient of resistance of tungsten and molybdenum disilicide, there is a large surge or inrush current when the filaments are first energized and until their resistance has increased to its operating level. In order to reduce this inrush current, for example to comply with regulations on disturbance to electricity supplies, it is known to provide a surge-limiting or ballast resistance in series with the filament. This resistance can take the form of a coiled bare resistance wire element which is supported on the insulating layer in the dish and augments the heat energy supplied by the filament. It is also known, for example, in EP 0 235 895, to provide a switch device which removes or reduces the ballast resistance a short time after the filament has been energized.

SUMMARY OF THE INVENTION

According to one aspect of this invention there is provided a radiant electric heater comprising a layer of electrical and thermal insulating material; a wall of electrical and thermal insulating material extending over the insulating material layer; at least one infra-red source means (for example an infra-red lamp) having a relatively high temperature coefficient of resistance; and resistive means arranged to be interposed temporarily in series with said source means upon energization thereof, said resistive means being located under said wall.

The heater may have a single infra-red lamp or other source means, or more than one such source. A second resistive means may be connected permanently in series with the source.

BRIEF DESCRIPTION OF THE DRAWINGS

Radiant electric heaters in accordance with this invention for use in a glass ceramic top cooker will now be described, by way of example, with reference to the accompanying drawings, in which.

DETAILED DESCRIPTION OF THE PREFERRED EMBODIMENTS

Figure 1:
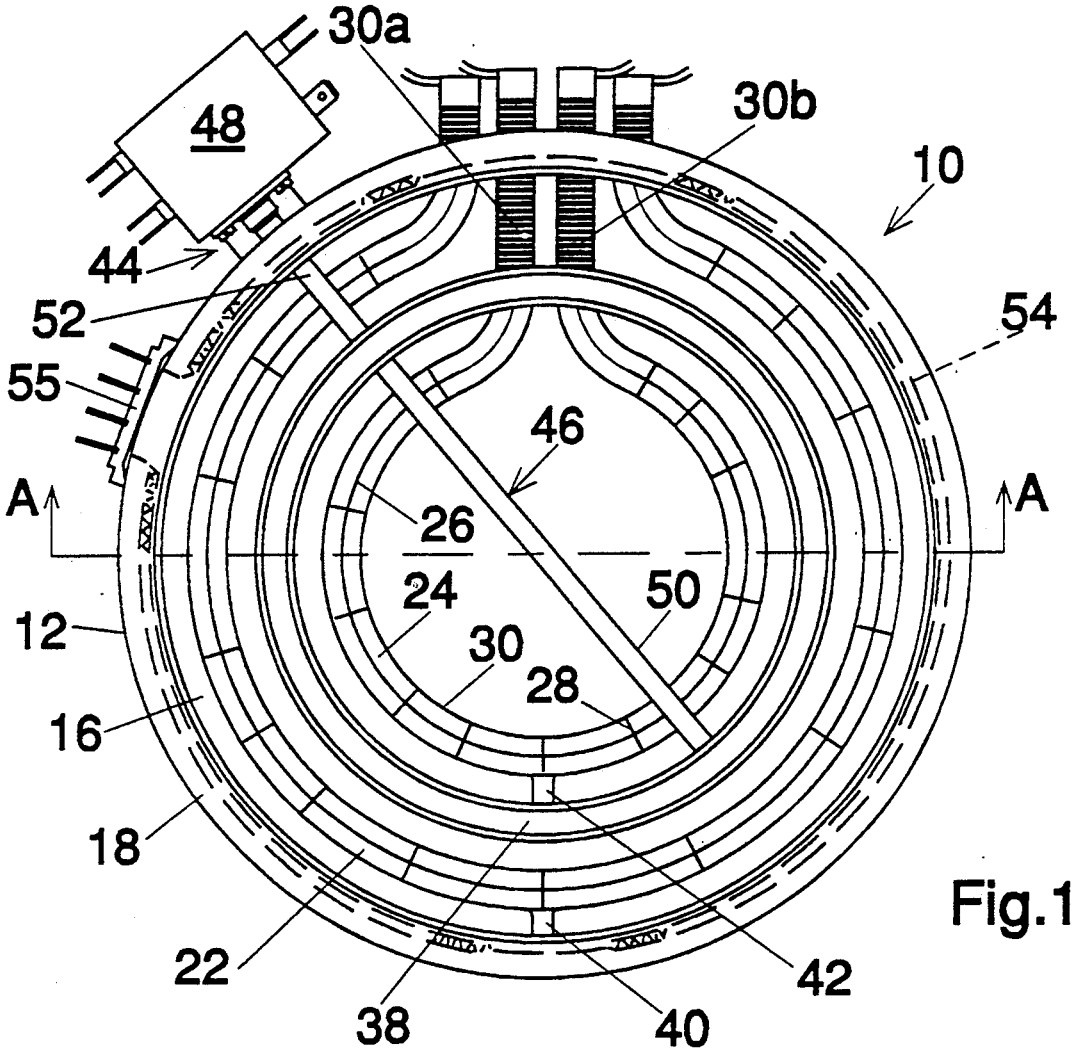
FIG. 1 is a plan view of a first heater.
Figure 2:
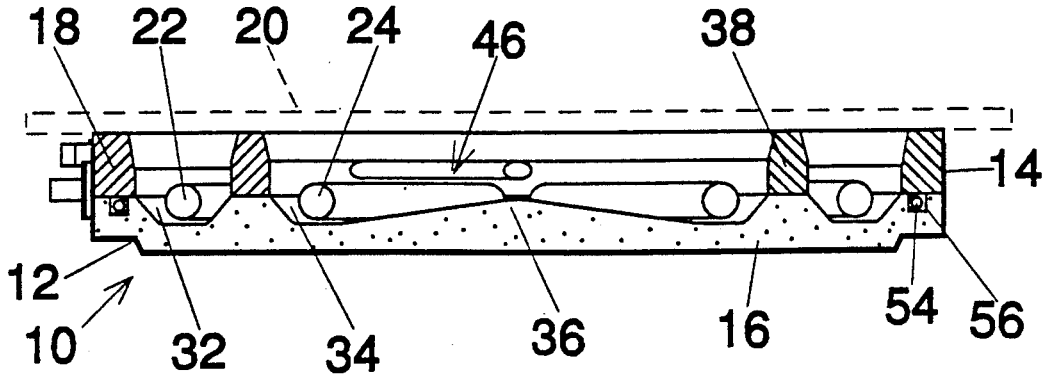
FIG. 2 is a sectional view of the heater of FIG. 1 along the line A—A.

Referring to FIGS. 1 and 2, a radiant electric heater 10 has a container in the form of a metal dish 12 with an upstanding rim 14 and containing a layer of electrical and thermal insulating material 16. This material is for example a microporous insulation which comprises a highly-dispersed silica powder, such as silica aerogel or pyrolytic (fumed) silica, mixed with ceramic fibre reinforcement, titanium dioxide opacifier and a small quantity of alumina powder to resist shrinkage, and which is compressed into the dish 12. A ring-shaped peripheral wall 18 of ceramic fibre extends around the inside of the rim 14 of the dish 12, on top of the layer 16 and protruding slightly above the edge of the rim 14. When installed in a glass ceramic top cooker the peripheral wall 18 is pressed against the underside of a glass ceramic cooking surface, shown in dashed outline at 20 in FIG. 2, the heater 10 being held in position by a spring or other mounting device (not shown).

In the example shown in FIGS. 1 and 2, two heat sources are provided in the form of tungsten-halogen infra-red lamps 22 and 24, but it should be noted that the invention is equally applicable to heaters with only one such source or with more than two. The lamps 22 and 24 are generally circular in configuration and arranged concentrically, and each contains a tungsten filament 26 supported approximately axially on spacers 28 within an infra-red transmissive fused silica envelope 30. These spacers are arranged closely enough together to maintain each filament 26 at the desired distance from its envelope 30 in between each pair of spacers 28 despite the curvature of the envelope 30. The filament 26 is secured at each end to connections brought out through flattened hermetic pinch seals at the ends of the envelope 30. These ends are adjacent one another, and the pinch seals extend generally radially of the heater 10 through recesses provided in the underside of the peripheral wall 18 and in the layer 16, and through holes in the rim 14 of the dish 12.

The surface of the layer 16 is contoured, as shown in FIG. 2, to reduce the concentration of heat on the glass ceramic cooking surface 20 immediately above the lamps 22 and 24, and to maintain an adequate thickness for the layer 16. Thus under the lamp 22 there is an annular depression 32, and under the lamp 24 there is another depression 34. Although the presence of these depressions also helps to minimize the overall height of the heater 10, it is considerably broader than is required for this purpose alone. The central region 36 of the layer 16, within the lamp 24, is made slightly convex.

A dividing wall 38 of ceramic fibre is provided between the lamps 22 and 24. The inner lamp 24 is intended to be used alone for heating smaller diameter utensils, or together with the outer lamp 22 for heating larger utensils. In order to reduce stray light when only the inner lamp 24 is energized, the sections of its envelope 30*a* and 30*b* which traverse the annular part of the heater outside the dividing wall 38 are coated with black paint, as are the ends of the lamp 22 outside the rim 14. The lamps 22 and 24 are retrained against movement by their ends and by protrusions (for example elongated exhaust tubes) 40 and 42 extending from their envelopes 30. The protrusion 40 from the outer lamp 22 is sandwiched between the peripheral wall 18 and the insulating layer 16, and the protrusion 42 from the inner lamp 24 is likewise sandwiched between the dividing wall 38 and the layer 16. Further details of this method of supporting the lamps 22 and 24 are given in patent specifications GB 2 220 333/EP 0 343 868.

As is customary with heaters for glass ceramic top cookers, a temperature sensitive rod limiter 44 is provided with its probe 46 extending across the heater 10 from the peripheral wall 18, over the outer lamp 22 on one side and over the inner lamp 24, as far as the dividing wall 38 on the far side. This probe typically comprises a fused silica tube containing a metal rod, which is preferably plated with a reflective material, such as silver, as described in GB 2 146 431. A double-pole snap-action switch 48 controlled by the probe 46 has one pole connected in series with the lamps 22 and 24, and a second pole which can be used to control a lamp indicating that the cooking surface 20 is hot.

The limiter 44 must be calibrated so that it operates to limit the temperature of the glass ceramic cooking surface correctly irrespective of whether only the inner lamp 24 is energized or both lamps 22 and 24 are energized. Accordingly, the limiter 44 is made insensitve to the heat in the annular area containing the lamp 22. To this end, the outer tube of the probe 46 is made in two pieces, a silica section 50 extending over the inner lamp 24 and a metal section 52 extending over the outer annular area of the heater 10. This metal section 52 has a similar coefficient of thermal expansion to the metal rod inside it, so that heat in the annular area of the heater 10 has little or no effect on the operation of the limiter 44. However, there is a possibility of initial heating of the metal section 52 causing delayed operation of the limiter when the lamps 22 and 24 are first energized. To avoid this, the metal section 52 may be plated, for example with silver, in the same way as the metal rod inside the probe 46.

A coil 54 of electric resistance wire is also provided, extending around the periphery of the heater 10, under the peripheral wall 18 in a groove 56 in the insulation layer 16. This coil is made of material having a much lower temperature coefficient of resistance than the filaments 26, for example from an iron-chromium-aluminum alloy. The diameter of the coil 54 is typically of the order of 4 to 4.5 mm, and the groove is located with its outer side at least 5 mm from the rim 14 of the dish 12, to maintain electrical isolation. The coil 54 has straight sections where it extends past the ends of the lamps 22 and 24, and past the protrusion 40, and its ends are secured to an electrical connector block 55.

Figure 3:
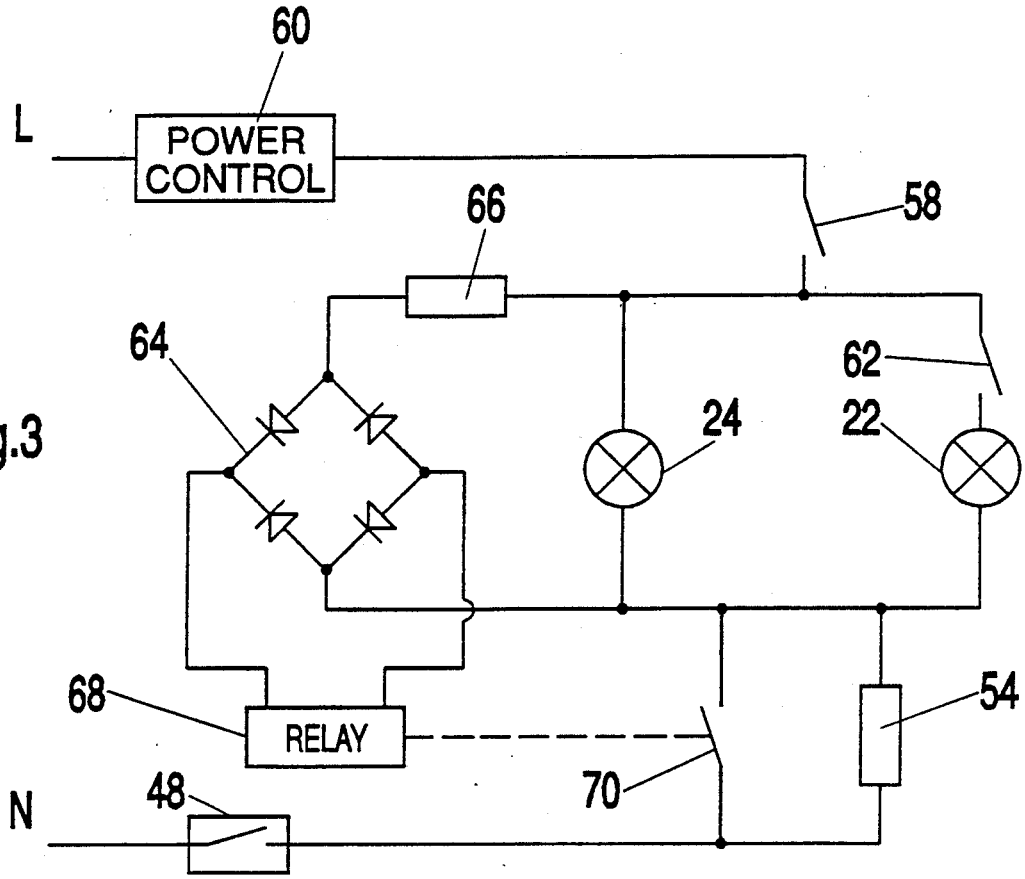
FIG. 3 is a schematic circuit diagram showing the heater of FIG. 1 and related components.

As shown in FIG. 3, the resistance wire coil 54 is connected via the limiter 48 between one pole N of an electrical supply and one terminal of each of the lamps 22 and 24. The second terminal of the inner lamp 24 is coupled to the other pole L of the electric supply via a user-operable switch 58 and a power control unit 60 (such as a cyclic energy regulator). The second terminal of the outer lamp 22 is also coupled to the switch 58, but via a second user-operable switch 62 by means of which the user can select whether or not the lamp 22 is energized with the lamp 24.

A bridge rectifier 64 is coupled via a voltage reducing resistor 66 in parallel with the inner lamp 24, and supplies the actuating coil of a 96 V d.c. relay 68 which controls a switch 70 connected in parallel with the resistance wire coil 54.

The parallel resistance of the lamps 22 and 24 when they are cold (i.e. de-energized) is typically of the order of 2 ohms for an 1800 W heater (e.g. lamps 22 and 24 of 1000 W and 800 W respectively). However, when they are energized and at their normal operating temperature, their parallel resistance is around 25–30 ohms. The resistance of the coil 54 is chosen to be of a similar order of magnitude to the resistance of the lamps at their operating temperature, for example in the range 10 to 30 ohms. When the lamp 24 is energized, alone or with the lamp 22, the voltage drop across the filament 26 of the lamp 24 is relatively small. This voltage is insufficient to actuate the relay 68, so the switch 70 remains open. Thus the coil 54 is in series with the lamp(s) and limits the initial surge of current through the cold lamp filament(s) 26. As the filament 26 in the lamp 24 heats up its resistance rises, so an increasing proportion of the supply voltage is dropped across the lamp 24. Ultimately this voltage reaches a value sufficient to actuate the relay 68, whereupon the switch 70 closes, short-circuiting the coil 54 and applying the full supply voltage directly to the lamp(s).

The time delay between energization of the lamp(s) and actuation of the relay 68 is a combination of the time delay before the voltage across the lamp(s) is sufficient to actuate the relay 68 and the inherent response time of the relay 68. As explained in EP 0 235 895, this arrangement provides an appropriate time delay, of at least several tens of milliseconds, without the need for additional timing components. It can be seen from FIG. 3 that when the relay 68 is actuated the full supply voltage is applied to the relay circuit and continues to be applied as long as the heater is energized. It is for this reason that a d.c. type is preferred for the relay 68, since this has a larger voltage tolerance than an a.c. type.

The value of the resistance of the coil 54 is selected, in conjunction with the characteristics of the resistor 66 and the relay 68, to provide sufficient limiting of the surge current through the cold lamp filaments without delaying unduly the rise in temperature of the filaments, and if possible to minimize any sudden change in lamp intensity when the relay 68 operates. In particular the range of these parameters is chosen to provide the desired operating characteristics when both lamps 22 and 24 are energized (the worst case condition, with maximun surge current). Adjustments within this range may be made to provide acceptable operation when only the lamp 24 is energized. Although the coil 54 dissipates a large power, it does so for such a short time that it is feasible for aesthetic reasons to enclose it between the layer 16 and the peripheral wall 18 without subjecting it to excessive temperatures.

Figure 4:
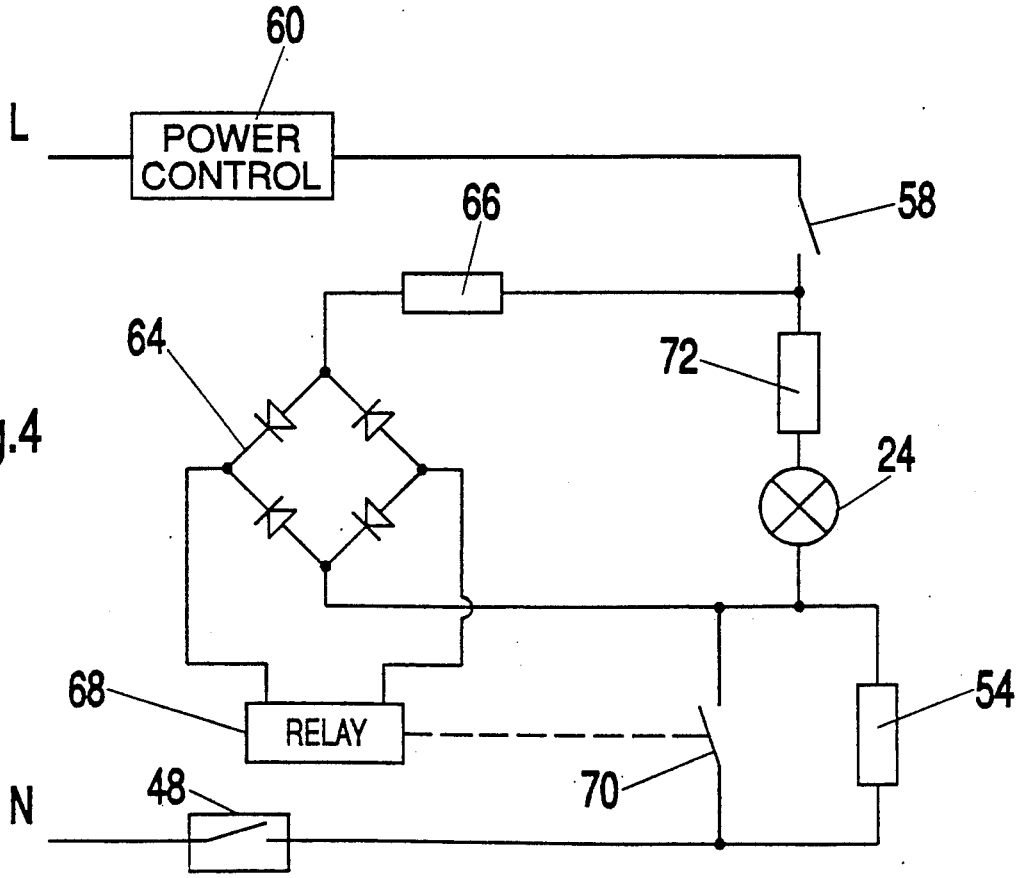
FIG. 4 is a schematic circuit diagram of a second heater and related components.

As noted above, the invention may also be used, for example, in a heater having only a single infra-red lamp or like heat source, in which case the dividing wall 38 would be omitted. The coil 54 may provide the sole limitation of surge current, or it may be used to solve a problem associated in particular with larger, higher power heaters having a surge current limiting resistor permanently in series with the lamp. In such heaters, of the order of 2200 W or more, the current-limiting resistance would need to be of the order of 60–70% of the overall heater resistance in the energized condition in order to conform with regulations on disturbance of electricity supplies. However, if the permanent series resistor is made this size, an unduly high proportion of the power provided by the heater is dissipated in the series resistor. FIG. 4 shows an arrangement which resolves this problem.

Referring to FIG. 4, the single lamp 24 has a resistance 72 connected permanently in series with it. This resistance is conveniently disposed on the insulating layer 16, for example within the circular area bounded by the lamp 24. The remainder of the circuit is as described with reference to FIG. 3, like reference numerals being used to identify like components. The resistance 72 has a value providing approximately 40% of the overall heater resistance (that is, lamp 24 plus resistance 72) when the heater is in its energized condition. The coil 54 provides the additional resistance needed to limit inrush current when the heater is switched on, but this additional resistance is bypassed by the switch 70 during normal operation to maintain an appropriate proportion of power dissipation in the lamp 24.

Various other modifications may be made to the arrangements shown and described. In the embodiment of FIGS. 1 to 3, for example, the coil 54, or another like it, may be located under the dividing wall 38.

Figure 5:
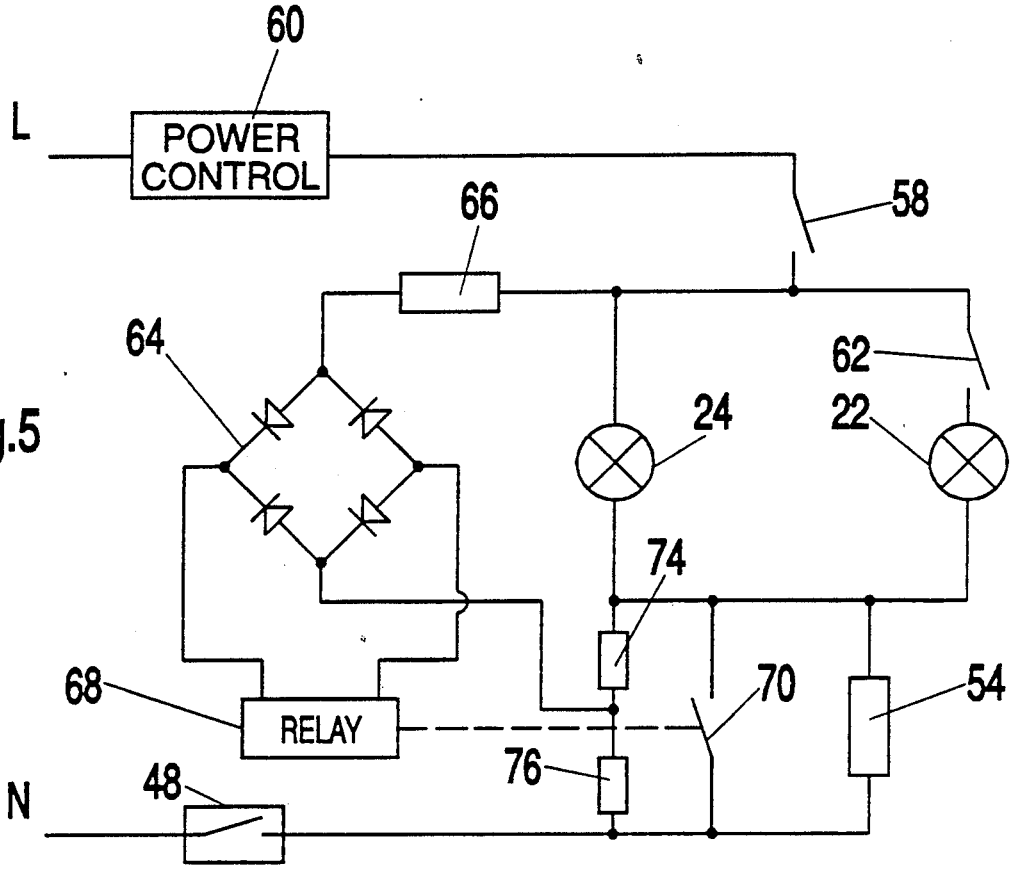
FIGS. 5 and 6 are schematic circuit diagrams showing modifications to the arrangement of FIG. 3.

The switching of the coil 54 out of the lamp series circuit can be effected in other ways than with a relay having its actuating coil across the lamp. Thus, as shown in FIG. 5, one terminal of the bridge rectifier 64 may be coupled to the mid-point of a pair of resistors 74 and 76 constituting a voltage divider connected in parallel with the resistance wire coil 54 and the relay switch 70. This has the advantage of reducing the difference between the minimum voltage which must be applied to the relay 68 to operate it and the maximum continuous voltage which it must sustain after the switch 70 has closed. For a 240 volt supply and a 2 kilowatt heater these resistors typically have a value of the order of 10–20 kilohms each.

Figure 6:
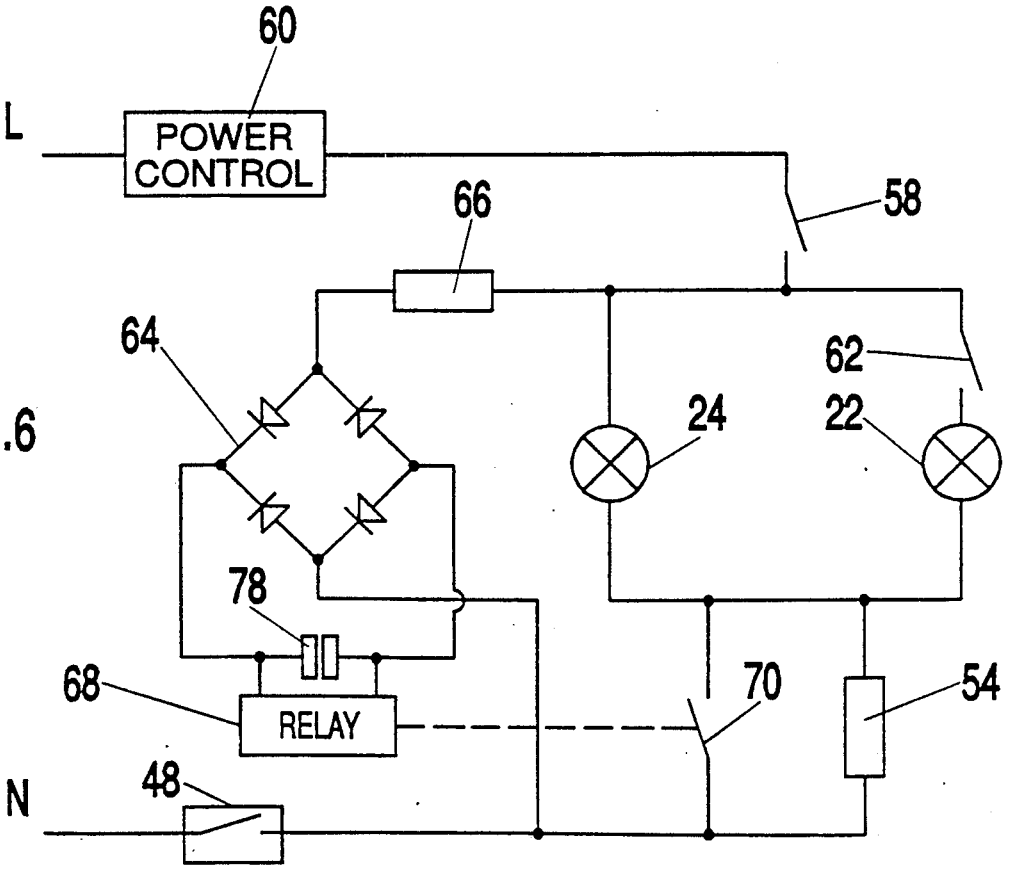

Alternatively the bridge rectifier 64 may be connected directly to the limiter switch 48, as shown in FIG. 6, and a capacitor 78 connected in parallel with the relay 68 to cooperate with the resistor 66 to provide the required delay in addition to the relay's inherent response time.

We claim:

1. A radiant electric heater comprising:

a layer of electrical and thermal insulating material;

a wall of electrical and thermal insulating material extending over the insulating material layer;

at least one infra-red source means having a relatively high temperature coefficient of resistance; and resistive means arranged to be interposed temporarily in series with said source means upon energization thereof, said resistive means being located under said wall.

2. The heater of claim 1, wherein there is a single source means such as an infra-red lamp.

3. The heater of claim 1, wherein a second resistive means is connected permanently in series with the source means.

4. The heater of claim 1, wherein said wall is disposed adjacent the periphery of the heater.

5. The heater of claim 1, wherein said temporary interposition of said resistive means in series with said source means is controlled by switch means responsive to the voltage developed across said source means.

6. The heater of claim 1, wherein said temporary interposition of said resistive means in series with said source means is controlled by switch means responsive to the voltage developed across said source means and a voltage divider coupled in parallel with said resistive means.

7. The heater of claim 1, wherein said temporary interposition of said resistive means in series with said source means is controlled by switch means responsive to the supply voltage and incorporating a capacitor to provide a delay interval.

8. The heater of claim 5, wherein said switch means comprises a relay.

9. The heater of claim 6, wherein said switch means comprises a relay.

10. The heater of claim 7, wherein said switch means comprises a relay.

* * * * *